US005977855A

United States Patent [19]

Matsumura et al.

[11] Patent Number: 5,977,855

[45] Date of Patent: Nov. 2, 1999

[54] MOLDED TRANSFORMER

[75] Inventors: Katsumi Matsumura; Yutaka Hirooka; Kazunari Ishikawa, all of Toyooka; Masayuki Mizushima, Hyogo-ken; Ken Koyama, Hyogo-ken; Yoshio Sugitatsu, Hyogo-ken, all of Japan

[73] Assignee: Matsushita Electric Industrial Co., Ltd., Osaka, Japan

[21] Appl. No.: 07/979,784

[22] Filed: Nov. 20, 1992

[30] Foreign Application Priority Data

| | | | |
|---|---|---|---|
| Nov. 26, 1991 | [JP] | Japan | 3-310528 |
| Dec. 17, 1991 | [JP] | Japan | 3-103887 U |
| Dec. 17, 1991 | [JP] | Japan | 3-103889 U |
| Jan. 30, 1992 | [JP] | Japan | 4-014573 |

[51] Int. Cl.[6] ..... H01F 27/02; H01F 27/29; H01F 27/30

[52] U.S. Cl. ..... 336/96; 336/92; 336/205; 336/192

[58] Field of Search ..... 336/90, 96, 205, 336/65, 192

[56] References Cited

U.S. PATENT DOCUMENTS

| | | | |
|---|---|---|---|
| 2,574,417 | 11/1951 | Rowe . | |
| 3,570,119 | 3/1971 | Baker . | |
| 3,947,796 | 3/1976 | Postma et al. | 336/192 |
| 4,085,086 | 4/1978 | Mizuno et al. | 260/40 |
| 4,490,706 | 12/1984 | Satou et al. | 336/96 |
| 4,800,357 | 1/1989 | Nickels, Jr. et al. | 336/198 |
| 4,939,494 | 7/1990 | Masuda et al. | 336/96 |
| 4,985,984 | 1/1991 | Umezaki | 336/96 X |
| 5,015,981 | 5/1991 | Lint et al. | 336/65 |
| 5,028,904 | 7/1991 | Kurano | 336/96 |
| 5,034,854 | 7/1991 | Matsumura et al. | 336/96 X |

FOREIGN PATENT DOCUMENTS

| | | | |
|---|---|---|---|
| 0400619A1 | 12/1990 | European Pat. Off. . | |
| 1259756 | 3/1961 | France . | |
| 2640072A1 | 3/1978 | Germany . | |
| 1283804 | 11/1989 | Japan . | |
| 2037087 | 7/1980 | United Kingdom | 336/96 |
| 91/09441 | 6/1991 | WIPO . | |

*Primary Examiner*—Michael L. Gellner
*Assistant Examiner*—Anh Mai
*Attorney, Agent, or Firm*—Stevens, Davis, Miller, & Mosher, L.L.P.

[57] ABSTRACT

A molded transformer includes a transformer body including a coil bobbin having a spool having a central through-hole and a collar at each of two ends thereof, and a conductive wire, such as a copper wire, wound around the spool, and an EE type or EI type ferrite core which is inserted into the coil bobbin; and a thermoplastic resin for molding the transformer body in such a manner that only a terminal portion used for mounting is exposed through the resin. The resin has a low molecular weight, ensuring a low molding stress and a low melting viscosity.

11 Claims, 6 Drawing Sheets

MOLDED TRANSFORMER

BACKGROUND OF THE INVENTION

1. Field of the Invention

The present invention relates to a molded transformer which is used in various types of video apparatus, household electric appliances, acoustic apparatus, industrial apparatus or communication apparatus.

2. Description of the Related Art

A conventional transformer will be described below.

FIG. 11 shows the internal structure of a conventional transformer. A spool 1 has a central through-hole 2. The spool 1 also has a collar 8 at each of the two ends thereof, and a lower collar 4 at the lower end of each of the collars 8. Maker terminals 5 for wiring and user terminals 6 used by the user are formed integrally with the spool 1. A conductive wire 3, such as a copper wire, is wound around the spool 1 and is connected to the maker terminals 5 to form a coil bobbin. An EE type or EI type ferrite core 7 inserted into the coil bobbin 1 is fixed to the coil bobbin 1 by coating an adhesive 14, such as an epoxy resin, on the joining surface of the ferrite core 7 and then by heat setting the adhesive 14 at a temperature ranging from 100° C. to 200° C. to form a transformer body in which a closed magnetic path is formed. The thus-arranged transformer body is inserted into a casing 9 made of a plastic resin, a highly insulated resin 10, which may be silicon resin, is injected into the casing 9, and then the casing 9 is sealed by a bottom plate 11, which may be made of a plastic resin, in such a manner that the user terminals 6 are exposed through the resin to form a transformer.

FIG. 12 shows a shielded type transformer in which a box-shaped shielding casing 12 covers the transformer arranged in the manner described above from above.

In the aforementioned conventional transformer, the number of parts is large, and the production process is complicated. The plant and equipment investment required for automating the wire winding process and the core assembly process, which are necessary for the function of the transformer, increases the amount which has to be invested but this investment has a beneficial effect. The plant and equipment investment required for automating the subsequent processes, such as the casing insertion process, the silicon injection process and the bottom plate insertion process, which are necessary for the additional functions, increases the amount which has to be invested too much.

Furthermore, since the conventional transformer is manufactured by combining and fitting the bare transformer body, the casing and the bottom plate, the shape of the transformer and the dimensions of the user terminals are very unstable. This deteriorates the yield of the transformer automatic mounting process performed by the user.

A reduction in the number of parts and an improvement in the shape of the transformer and in the dimensional accuracy of the user terminals may be achieved by plastic molding the entire transformer. Generally, plastic molding employs thermosetting resins, such as an epoxy resin. The thermosetting resins require a long molding time, and generate burrs during molding. Therefore, a burr removing process must be conducted after molding, and the productivity of the molding process is thus low.

In the conventional transformer, when a transmission noise, which is an externally radiant noise induced in the transformer and transmitted to the circuit, is generated or when a malfunction of the circuit occurs due to leaking magnetic flux generated from the transformer, the transformer body is covered with the box-shaped shielding casing 12 to suppress, the influence of the noise. However, this increases assembly manhours. Also, when the user desires to mount the parts with a high density, insulation between the adjoining parts must be provided. Therefore, the transformer mounting position is limited, thus limiting the high-density mounting of the parts.

Furthermore, since the joining surface of the EE type or EI type ferrite core 7 is fixed using the adhesive 14 in the core assembly process, the adhesive 14 coating and setting processes are required, making the production process complicated. Also, since an epoxy type thermosetting adhesive having a high mechanical strength and a high heat resistance is generally employed to adhere the ferrite core 7, setting of the adhesive 14 requires a setting tank of a temperature ranging from 100 to 200° C., thus increasing the amount which has to be invested in plant and equipment.

SUMMARY OF THE INVENTION

An object of the present invention is to provide a molded transformer which enables deterioration in the characteristics thereof to be eliminated, which enables the shape and the dimensional accuracy of the user terminals to be improved, and which enables the production process to be simplified and the production cost to be reduced by reducing the number of parts.

To achieve the above object, the present invention provides a transformer which comprises: a transformer body including a coil bobbin having a spool having a central through-hole, and a conductive wire, such as a copper wire, wound around the spool, and an EE type or EI type ferrite core which is inserted into the coil bobbin to form a closed magnetic path; and a thermoplastic resin for molding the transformer body, the thermoplastic resin having a low-molecular-weight ensuring a low molding stress and a low viscosity.

In the molded transformer according to the present invention, a recessed portion may be formed in the lower portion of the molding resin, in the lower portion thereof over an entire width of the transformer as defined by two end surfaces thereof between the terminals, or at a center of the upper portion of the molding resin.

A box-shaped shielding casing may be incorporated in the transformer body in such a manner that it surrounds the core and the upper surface of the coil. The shielding casing has an expanded ring portion for pressing against and thereby fixing the core at a position where it faces each of two side surfaces of the core in the direction of insertion thereof.

After the EE type or EI type core has been retained by means of the core retaining protrusion, it may be completely fixed by the molding of the coil bobbin having the core retaining protrusion on the collar thereof and wound with a conductive wire, such as a copper wire.

When the transformer body is molded using a thermoplastic resin having a low molecular weight and a low melting viscosity, the molding stress and the stress of shrinkage, which would be applied to the ferrite core, can be reduced, thus greatly reducing an inductance and core cracks. However, the thickness of the molding resin is non-uniform in the vicinity of the ferrite core, and this causes a stress due to shrinkage of the resin which is different between the thicker and thinner portions to be applied to the ferrite core. Hence, a recessed portion is provided in the thick portion of the resin in the lower portion of the transformer to make the thickness of the molding resin uniform and thereby make the molding shrinkage uniform. Thus, no stress due to the shrinkage is applied to the ferrite core, and molding can be performed without deteriorating the characteristics of the transformer.

Furthermore, since resin molding of the entire outer periphery of the transformer body is possible, the number of parts can be reduced from three parts which are the casing, the bottom plate, and the injected resin, required in the conventional transformer, to one part which is the molding resin, and the fitting of the parts is eliminated. Consequently, assembly is simplified, and the shape of the transformer and the dimensional accuracy of the user terminals are improved. Furthermore, in the case of a transformer which is capable of coping with the surface mounting, a special thermoplastic resin which can resist high temperatures of 250° C. or above, such as a liquid crystal polymer, is used to achieve a closed magnetic path ferrite core type completely resin molded transformer.

A leaking magnetic path generated from the transformer can be suppressed, while the influence of the external radiant noise can be eliminated, by inserting the core into the coil bobbin to form a closed magnetic path and then by covering the core and the upper surface of the coil with a box-shaped shielding casing. Furthermore, the adhesion process of the core can be omitted and the production process and the work can be simplified by fixing the core by means of the shielding casing. Furthermore, molding of the transformer body including the shielding casing provides an electrical insulation between the adjoining parts, and thus achieves a high-density mounting.

Furthermore, the core is retained by the core retaining protrusion by inserting it into the coil bobbin. The adhesion process of the core can be eliminated by molding the transformer body with the core retained.

DETAILED DESCRIPTION OF THE PREFERRED EMBODIMENTS

Figure 1:
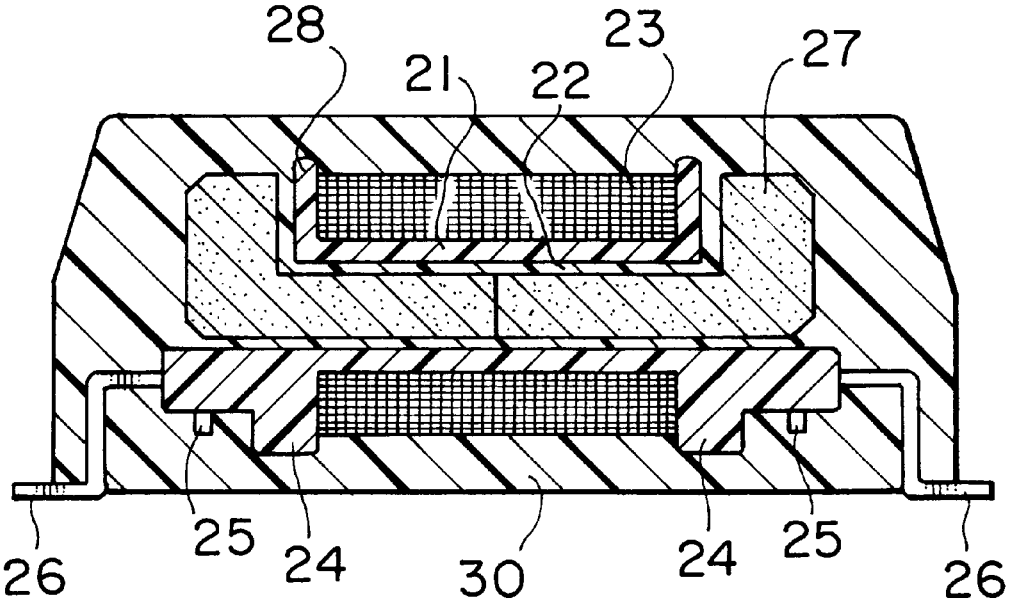
FIG. 1 is a cross-sectional view of a molded transformer showing a first embodiment of the present invention.

FIG. 1 shows the internal structure of a first embodiment of a molded transformer according to the present invention. In the transformer shown in FIG. 1, a spool 21 has a central-through-hole 22. The spool 21 also has a collar 28 at each of the two ends thereof, and a lower collar 24 at the lower end of each of the two ends thereof. The spool 21 has maker terminals 25 for wiring and user terminals 26 used by the user formed integrally therewith. A conductive wire 23, such as a copper wire, is wound around the spool 22 and is connected to the maker terminals 25 to form a coil bobbin. An EE type or EI type ferrite core 27 is inserted into the coil bobbin to form a transformer body in which a magnetic path is formed. The transformer body is molded by a thermoplastic resin 30 having a low-molecular-weight of 15000 or less and a melting viscosity of 500 PS or less in such a manner that the user terminals 26 alone are exposed through the molding resin. Molding is performed under a low injection pressure.

A second embodiment of the present invention will be described below with reference to the figure used to describe the first embodiment. The second embodiment differs from the first embodiment in that the transformer body is molded using a special thermoplastic resin 30 which has a low-molecular-weight of 15000 or less ensuring a low molding stress, a melting viscosity of 500 PS or less, and a high heat-resistance of 250° C. or above, such as a liquid crystal polymer, to provide a closed magnetic path ferrite core type molded transformer which is capable of coping with the face mounting. Molding is performed under a low injection pressure.

Figure 2A:
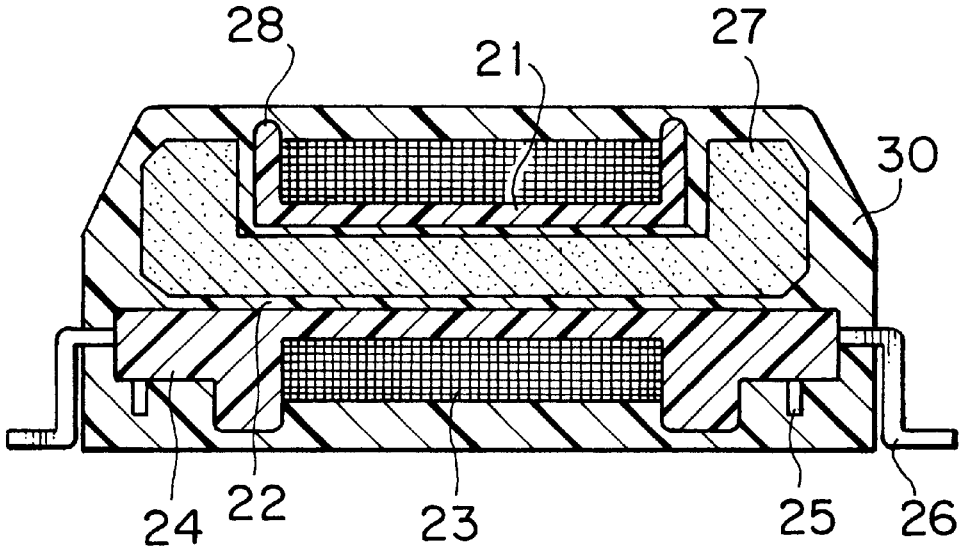
FIG. 2A is a cross-sectional view of a molded transformer as seen when looking from the front surface thereof, showing a third embodiment of the present invention.
Figure 2B:
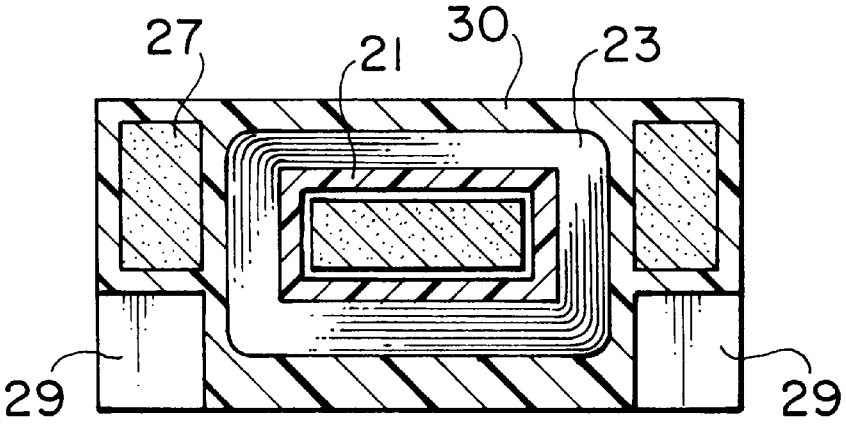
FIG. 2B is a cross-sectional view of a molded transformer as seen when looking from the side surface thereof showing the third embodiment of the present invention.
Figure 3:
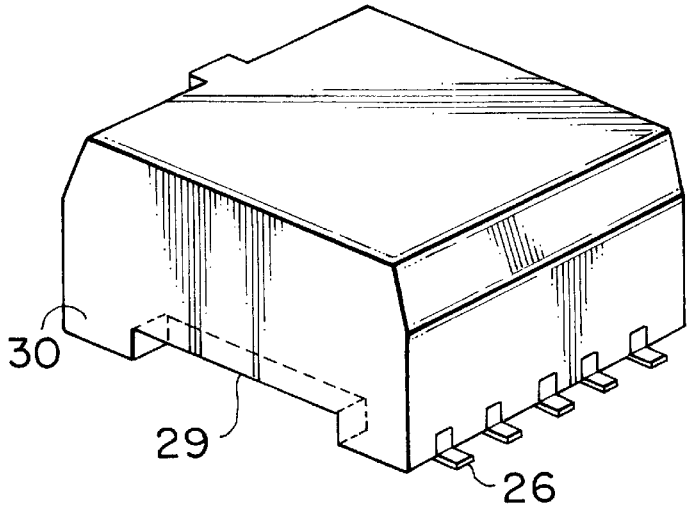
FIG. 3 is a perspective view of the molded transformer showing the third embodiment of the present invention.

A third embodiment of the present invention will be described below with reference to FIGS. 2A, 2B and 3.

The third embodiment differs from the second embodiment in that a recessed portion 29 is provided below the ferrite core 27 so that the thickness of the resin 30 can be made uniform in the vicinity of the ferrite core 27 when the transformer body is molded by the thermoplastic resin 30 having a low-molecular-weight of 15000 or less ensuring a low molding stress and a low melting viscosity of 500 PS or less under a low injection pressure to provide a ferrite core type completely plastic molded transformer.

Figure 4:
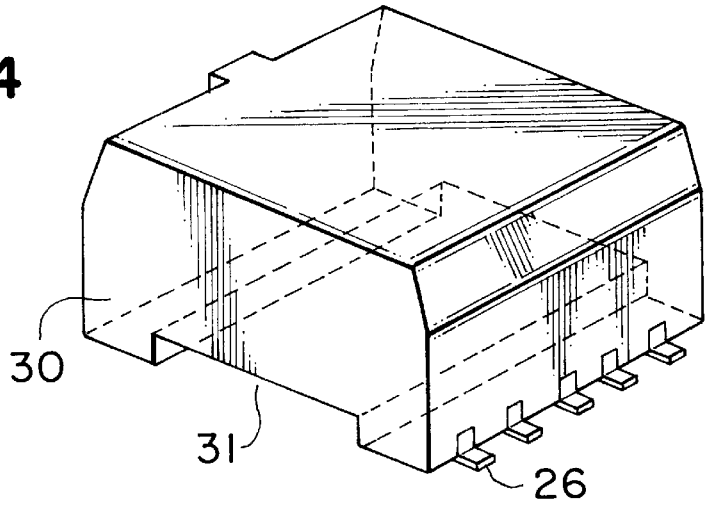
FIG. 4 is a perspective view of the molded transformer showing a fourth embodiment of the present invention.

A fourth embodiment of the present invention will be described below with reference to FIG. 4.

The fourth embodiment differs from the third embodiment in that the recessed portion 31 formed in the lower portion of the molded transformer only below the ferrite core 27 in the third embodiment extends over the entire width of the molded transformer as defined by the two end surfaces of the transformer between the terminals in the fourth embodiment.

Figure 5:
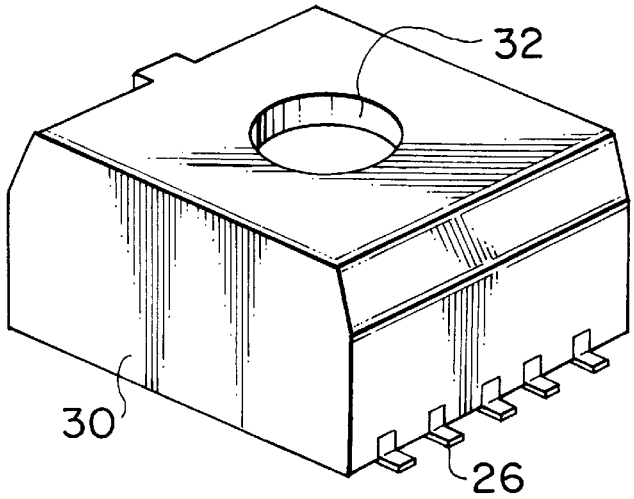
FIG. 5 is a perspective view of the molded transformer showing a fifth embodiment of the present invention.

A fifth embodiment of the present invention will be described below with reference to FIG. 5.

Whereas the recessed portion 29 is formed in the lower portion of the molded transformer in the third embodiment, the recessed portion 29 is formed in the upper portion of the molded transformer by bending the user terminals 26. Also, a recessed portion 32 is provided at the center of or near the center of the upper portion of the molded transformer.

Figure 6:
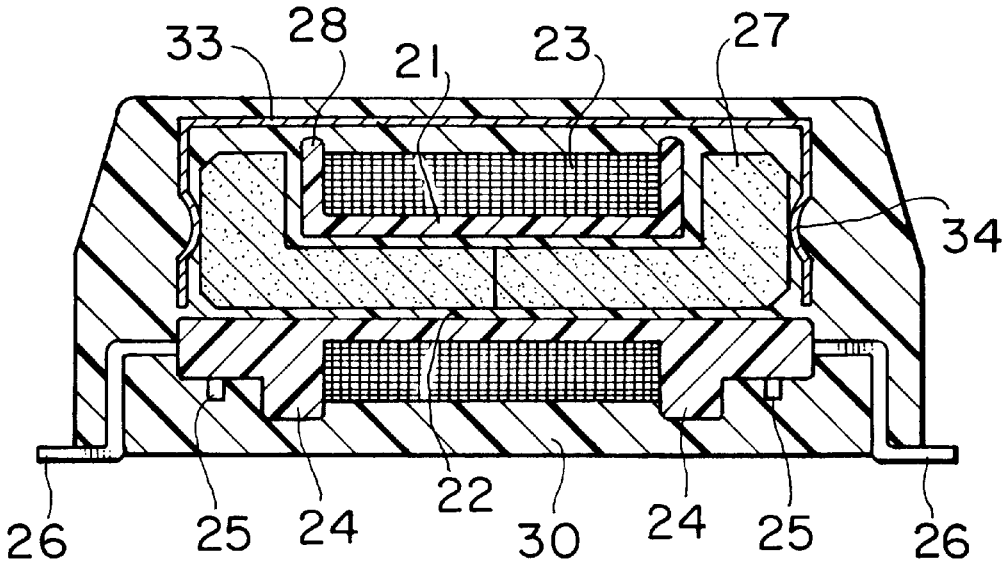
FIG. 6 is a cross-sectional view of the molded transformer showing a sixth embodiment of the present invention.
Figure 7:
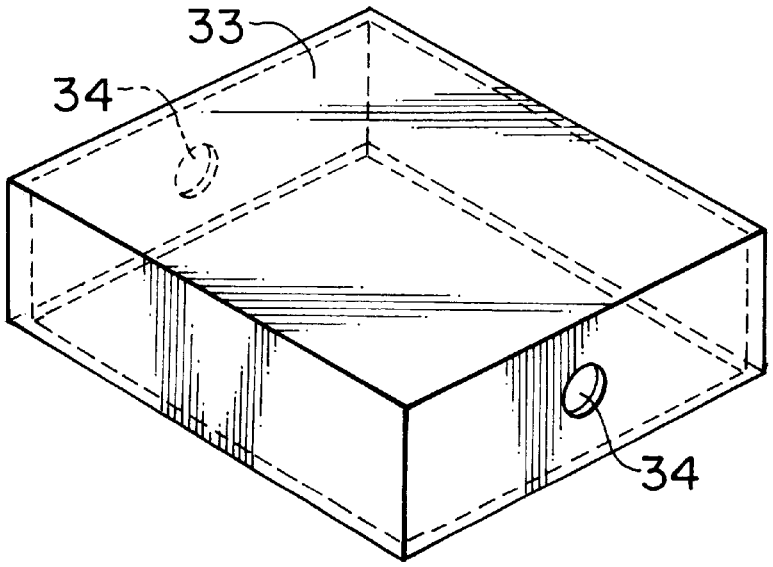
FIG. 7 is a perspective view of a shielding casing in the sixth embodiment of the present invention.

A sixth embodiment of the present invention will be described below with reference to FIGS. 6 and 7.

In the sixth embodiment, the EE type or EI type magnetic core 27 is inserted into the coil bobbin of the molded transformer of the first embodiment, and then a box- shaped shielding casing 33, having a circular expanded ring portion 34 at the center of each of core contact surfaces thereof which face the two sides of the core 27 in the direction of insertion of the core, is inserted from above the core 27 in such a manner that it surrounds the periphery of the core 27 and the upper surface of the coil. The circular expanded ring portions 34 press against the two sides of the core 27. After the core 27 is fixed, the transformer body is molded by the resin 30.

In this embodiment, the expanded ring portion 34 of the shielding casing 33 has the circular form but it may have any other form, such as an elliptical or elongated form, as long as it can be easily processed during the formation of the shielding casing 33. Furthermore, it is possible to provide a plurality of expanded ring portions 34 at any position on each of the core contact surfaces of the shielding casing 33 which face the two sides of the core 27 in the direction of the insertion thereof.

Figure 8:
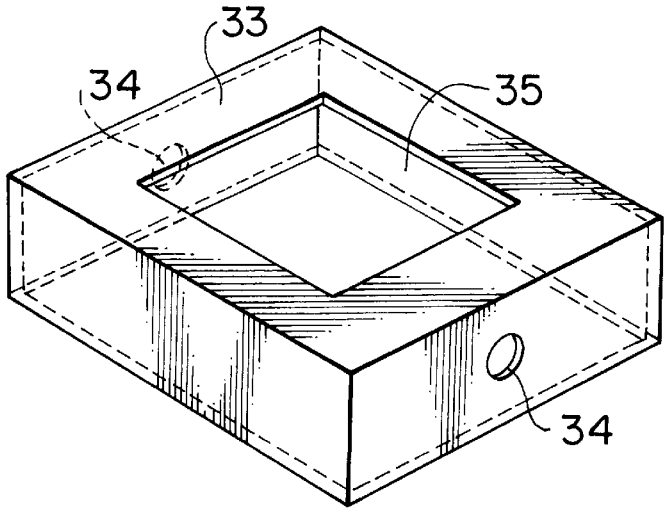
FIG. 8 is a perspective view of the shielding casing in a seventh embodiment of the present invention.

A seventh embodiment of the present invention will be described below with reference to FIG. 8.

The seventh embodiment is the application example of the shielding casing 33 which is described in the sixth embodiment. This embodiment is applied when the level of leaking magnetic flux or external radiant noise is low or when it is necessary for the core 27 alone to be shielded. In this embodiment, a hole 35 is formed in the upper surface of the shielding casing 33 at a position corresponding to only the upper surface of the coil so that it surrounds only the core 27.

Figure 9:
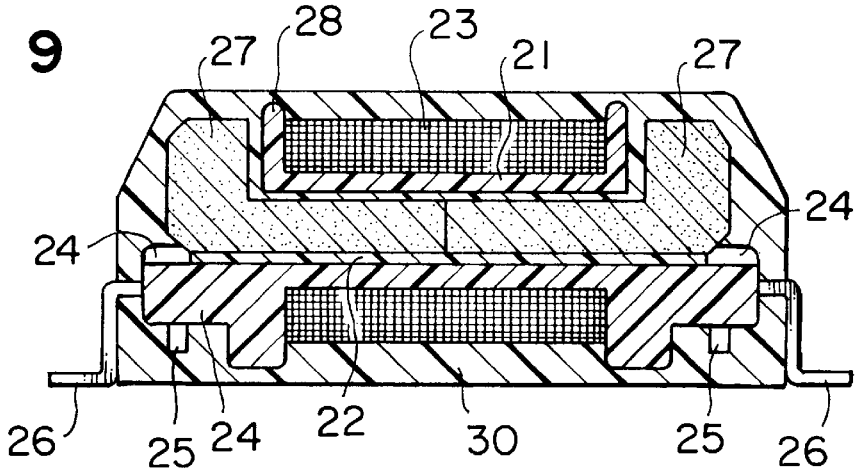
FIG. 9 is a cross-sectional view of the molded transformer showing an eighth embodiment of the present invention.

An eighth embodiment of the present invention will be described below with reference to FIG. 9.

In the molded transformer of the eighth embodiment, a spool 21 has a central through-hole 22, and a collar 28 at each of the two ends thereof and a core retaining protrusion 36 at a desired position of each of the collars 28. The core retaining protrusion 36 has a shape which corresponds to the shape of the ferrite core 27. A conductive wire 23, such as a copper wire, is wound around the spool 21 and is connected to the maker terminals 25 to form a coil bobbin. An EE type or EI type ferrite core 27 is inserted into the coil bobbin until it abuts against the core retaining protrusions 36. A transformer body in which the ferrite core 27 is temporarily fixed in the coil bobbin is molded by the molding resin 30 to form a molded transformer in which the ferrite core 27 is completely fixed.

A ninth embodiment of the present invention will be described below with reference to FIG. 9.

In the coil bobbin of the molded transformer described in the eighth embodiment, a core retaining protrusion 36 having, for example, a trapeszoidal shape corresponding to the shape of the core is provided at the end surface of each of the expanded portions 24 below the collars 28 and at a position on the horizontal extension of the through-hole 22.

Figure 10:
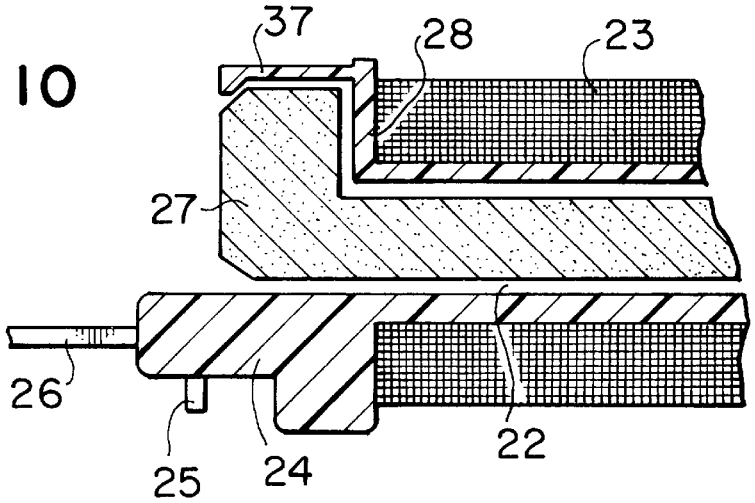
FIG. 10 is a cross-sectional view of the essential parts of the molded transformer showing a tenth embodiment of the present invention.
Figure 11:
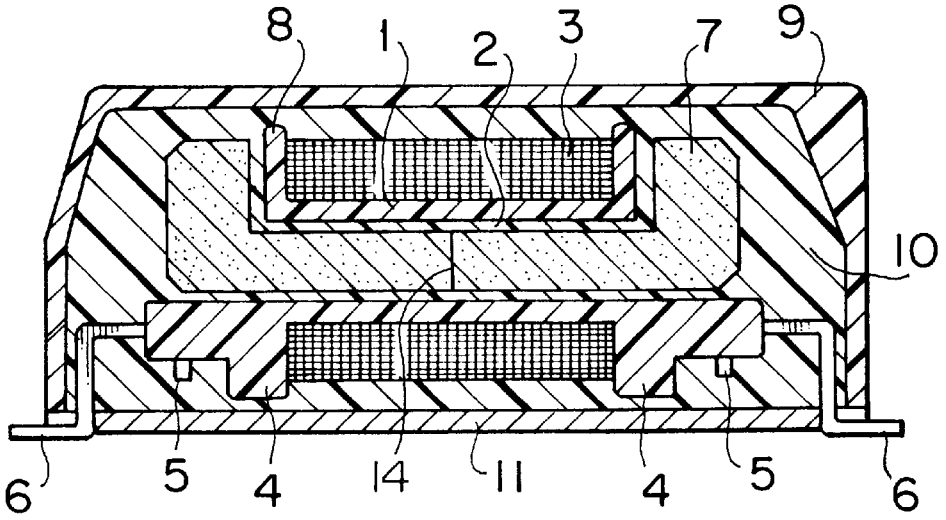
FIG. 11 PRIOR ART
FIG. 11 is a cross-sectional view of a conventional transformer.
Figure 12:
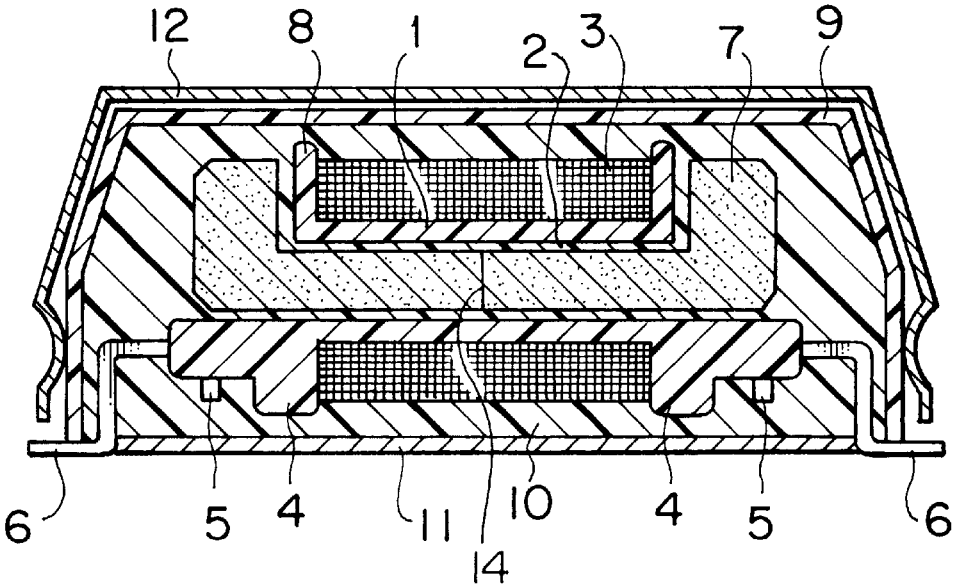
FIG. 12 PRIOR ART
FIG. 12 is a cross-sectional view of a conventional shielding type transformer.

A tenth embodiment will be described below with reference to FIG. 10.

In the coil bobbin of the molded transformer described in the eighth embodiment, a core retaining protrusion 37 is provided on the upper portion of each of the collars 28 in such a manner that it extends in the vertical direction with respect to the collar 28. The distal end of the core retaining protrusion 37 is formed in a key-like shape which engages with the end surface of the ferrite core 27.

As will be understood from the foregoing description, since the number of parts can be reduced from three parts which are the casing, the bottom plate and the injected resin, required in the conventional transformer, to one part which is the molding resin, fitting of the parts is eliminated. Consequently, assembly can be simplified, the productivity is improved, and the investment required for automated assembly process can be proposed. Furthermore, molding of the transformer improves the transformer shape and the dimensional accuracy of the user terminals.

Furthermore, stress due to the shrinkage generated when the ferrite core type transformer is molded can be eliminated, thus eliminating deterioration in the characteristics of the molded transformer. Furthermore, when the recessed portion is provided in the lower portion of the molded transformer over the entire width thereof, it can act as the guide when the transformer body is positioned during the assembly process. Furthermore, when the recessed portion is provided in the upper surface of the molded transformer, an adsorption nozzle of a mounting device can be inserted into the recessed portion when the molded transformer is mounted on a substrate. Therefore, a problem involving the erroneous adsorption of the parts by the mounting device, which would occur in a conventional case, can be eliminated.

Furthermore, since the molded transformer is shielded and since the adhesion process in the core assembly process is omitted, the production process can be further simplified while the productivity can be further improved.

What is claimed is:

1. A molded transformer comprising:

a transformer body including a coil bobbin having (i) a spool having two ends, a central through-hole and a collar at each of said two ends, (ii) a conductive wire wound around said spool, and (iii) an EE type or EI type ferrite core which is inserted into said central through-hole; and a thermoplastic resin in which said transformer body is molded such that only a terminal portion used for mounting is exposed through said resin, said resin having a low molecular weight of 15,000 or less, ensuring a low molding stress, and a low melting viscosity of 500 PS or less.

2. A molded transformer according to claim 1, wherein said thermoplastic resin comprises a highly heat resistant liquid crystal polymer having a heat resistance of 250° C. or more.

3. A molded transformer according to claim 1, wherein said molding resin has a recessed portion in the lower portion thereof.

4. A molded transformer according to claim 1, wherein said molding resin has a recessed portion in the lower portion thereof over an entire width of the transformer as defined by two end surfaces thereof between two terminals.

5. A molded transformer according to claim 1, wherein said molding resin has a recessed portion at a center of an upper portion thereof.

6. A molded transformer according to claim 1, further comprising a shielding casing which has a box-like shape which ensures that it surrounds a periphery of said core and an upper surface of said coil, said shielding casing having an expanded ring portion at a position where it faces each of two side surfaces of said core in a direction of insertion thereof, said expanded ring portion pressing against and fixing said core.

7. A molded transformer according to claim 6, wherein an upper surface of said shielding casing has a hole so that said shielding casing has a shape which ensures that it surrounds only said core.

8. A moulded transformer according to claim 7, wherein said core retaining protrusion is provided at the upper portion of said collar in a direction perpendicular to said collar, a distal end of said core retaining protrusion having a key- shaped from which engages with said core.

9. A molded transformer according to claim 1, wherein said coil bobbin has a collar having a core retaining protrusion.

10. A molded transformer according to claim 9, wherein said core retaining protrusion is provided on a side surface of an expanded portion located in the lower portion of said collar in which terminals are planted at a position on a horizontal extension of said through-hole.

11. A molded transformer according to claim 1, wherein said conductive wire is copper wire.

* * * * *